US005448775A

United States Patent [19]

Yamada et al.

[11] Patent Number: 5,448,775

[45] Date of Patent: Sep. 12, 1995

[54] BASEBALL GLOVE HAVING ENHANCED FLEXIBILITY

[75] Inventors: Minoru Yamada, Hyogo; Kazuhiro Kume, Wakayama; Hideki Tsuruoka, Nara; Hisanobu Fugahashi, Suita, all of Japan; Robin Smith, Mill Valley, Calif.; John E. Schulte, Hayward, Calif.; Robert J. Ball, Burlingame, Calif.; Robert J. Ready, Belmont, Calif.

[73] Assignee: Mizuno Corporation of America, Norcross, Ga.

[21] Appl. No.: 190,592

[22] Filed: Feb. 2, 1994

[51] Int. Cl.[6] ..... A41D 13/08

[52] U.S. Cl. ..... 2/19; 2/161.1

[58] Field of Search ..... 2/16, 18, 19, 20, 159, 2/161.1, 161.6, 161.5, 169, 163; D29/115

[56] References Cited

U.S. PATENT DOCUMENTS

| | | | |
|---|---|---|---|
| 2,288,467 | 6/1942 | Latina | 2/19 |
| 3,076,971 | 2/1963 | Steinman | 2/19 |
| 3,528,107 | 9/1970 | Rosenbaum | 2/19 |
| 3,909,848 | 10/1975 | Brockman | 2/19 |
| 4,339,830 | 7/1982 | Saski | 2/19 |
| 4,570,269 | 2/1986 | Berlese | 2/16 |
| 5,253,365 | 10/1993 | Clevenhagen | 2/19 |

*Primary Examiner*—Clifford D. Crowder
*Assistant Examiner*—Larry D. Worrell, Jr.
*Attorney, Agent, or Firm*—Troutman Sanders; Joel S. Goldman; Scott M. Frank

[57] ABSTRACT

The present invention relates to a baseball glove having means located on a bottom palm portion for enhancing glove flexibility. The baseball glove includes a thumb stall, at least one finger stall, and a hand receiving opening. The glove includes a notch formed in a lower portion of the glove, and at least one slit formed in a web portion such that the notch and slits increase flexibility of the glove and facilitate opening and closing of the glove.

10 Claims, 5 Drawing Sheets

BASEBALL GLOVE HAVING ENHANCED FLEXIBILITY

BACKGROUND OF THE INVENTION

1. Technical Field

This invention relates generally to a baseball (and softball) glove or mitt and more particularly to a strategically placed palm notch and a series of web slits on the glove which allow it to be more readily opened or closed.

The present invention has particular use among younger ball players or among those who have less hand strength. New ball gloves are particularly difficult to close because a heel portion of the palm is relatively stiff as compared with a center portion of the palm. Conventional gloves typically require a "break-in" period during which the heal portion creases and becomes more flexible. Generally, the heel portion of the glove is comprised of a stiff padded portion between several layers of thick leather which are stitched together. Due to its thickness, the heel portion is difficult to crease when the glove is new, making the glove difficult to open and close particularly for younger ball players who have less hand strength. Accordingly, there is a need for a more flexible baseball glove which can be readily opened and closed even when the baseball glove is flew.

2. Description of the Prior Art

Others have recognized the need to enhance the flexibility of a baseball glove for the purpose of reducing break-in time. An example of a prior utility patent directed to a baseball glove having an area of increased 5 flexibility is U.S. Pat. No. 4,527,287. The area of increased flexibility located on a backside of the glove, below the finger stalls, and directly above an opening for receiving the ball player's hand. There, the area of increased flexibility facilitates opening and closing of the glove. U.S. Pat. No. 4,847,915 is another example of a baseball glove having means to enhance glove flexibility. That glove employs a flexible heel portion which facilitates closing of the glove.

While the prior art designs of U.S. Pat. Nos. 4,527,287 and 4,847,915 allow for enhanced glove flexibility, no such known design has been developed which would virtually eliminate the break-in period for a new ball glove. By eliminating the break-in period, the young ball player may gain greater control over the glove in a shorter period of time than other more conventional gloves.

SUMMARY OF THE INVENTION

The present invention recognizes and addresses the foregoing disadvantages, and others of prior art constructions and methods.

Accordingly, it is an object of the present invention to provide for an improved baseball glove design which allows for enhanced glove flexibility.

It is another object of the present invention to provide for a baseball glove which allows for enhanced glove control.

It is another object of the present invention to provide for a baseball glove which eliminates the need for a break-in period.

It is another object of the present invention to provide for a baseball glove having structure which allows the glove to readily crease across a palm portion of the glove.

It is another object of the present invention to provide for a baseball glove which closes quickly around a ball.

It is another object of the present invention to provide for a baseball glove which is pleasing in appearance and durable in construction.

Generally speaking, the invention relates to a baseball glove having means located on a lower palm portion for enhancing glove flexibility. According to the present invention, the baseball glove includes a front ply forming a palm and front portion of the glove and a back ply forming a back portion of the glove. Fastening means are provided for fastening peripheral edges of the front and back plies together to form the glove. The glove includes a thumb stall, at least one finger stall, and a hand receiving opening. The glove includes a heel portion at a lower periphery of the front ply and a notch formed in a lower portion of the glove, such that the notch increases flexibility of the glove and thereby facilitates opening and closing of the glove.

More specifically, the invention relates to a baseball glove having a V-shaped notch including first and second notch portions in the front and back plies, respectively, between a finger stall and the hand receiving opening. The notch portions are disposed opposite one another at a lower portion of the palm such that the notch extends through an entire cross section of the glove. The first and second notch portions are separately bound such that the notch collapses upon itself when the glove is closed, thereby facilitating opening and closing of the glove.

A first embodiment of the present invention incorporates the notch in an open back glove. That embodiment includes a strap formed in the back ply for securing the glove onto a ball player's hand and wrist. The strap originates from a lower portion of the rear ply near the thumb stall. Also in accordance with the first embodiment, a continuous binding extends along an periphery of the strap to about a mid-point of an outer portion of the thumb stall. The continuous binding then reverses direction and runs parallel to itself on a peripheral edge of the front ply along an outer portion the thumb stall, extends along the heel and binds the front notch portion formed in the front ply, continues along an outer portion of the front ply on the finger stall, reverses direction, and runs parallel to itself on an outer portion of the rear ply on the finger stall. The continuous binding extends around a back notch portion formed in said back ply, extends around a lower portion of the back ply, forms an upper border of an inner opening on the back ply above the strap, and binds a second peripheral edge of the strap.

A second embodiment of the present invention incorporates the notch into a closed back glove. In the second embodiment, a continuous binding extends along a back portion of a hand receiving opening to about a mid-point of an outer portion of the thumb stall. The continuous binding then reverses direction and runs parallel to itself on a peripheral edge of the front ply along an outer portion of the thumb stall, extends along the heel and binds the front notch portion formed in the front ply, continues along an outer portion of the front ply on the finger stall, reverses direction, and runs parallel to itself on an outer portion of the rear ply on the finger stall. The continuous binding extends around a back notch portion formed in the back ply, and then extends around and binds the back portion of the hand receiving opening.

The present invention also includes at least one web slit formed in an upper edge of a web within the baseball glove for increasing glove flexibility by reducing the web's resistance to bending or creasing. In a preferred embodiment, several slits are formed on the upper edge of the web between the index finger stall and web lacing wrapped around the upper edge of the web. Normally, the web lacing increases the stiffness of top edge. The present invention, however, provides for a break in the lacing near the index finger stall allowing a crease or fold to readily form in the web near the slits, thereby providing additional flexibility on the top portion of the web. Thus, the break in web lacing in combination with the slits maximizes web flexibility. The break in lacing and slits may be formed along any portion of the top edge of the web, however, the preferred embodiment forms the slits in the vicinity of an a finger stall. The web slits, web lacing arrangement, and the V-shaped notch in the lower portion of the glove palm may each be used alone or in combination with each other to maximize flexibility of any type of baseball glove. The illustrated embodiment, however, utilizes the web slits and the V-shaped notch in the palm to maximize flexibility, thereby facilitating opening and closing of the glove.

Other objects, features and aspects of the present invention are discussed in greater detail below.

BRIEF DESCRIPTION OF THE DRAWINGS

The accompanying drawings illustrate the preferred embodiment of the invention, and serve to aid in the explanation of the principles of the invention.

DETAILED DESCRIPTION OF THE INVENTION

Figure 1:
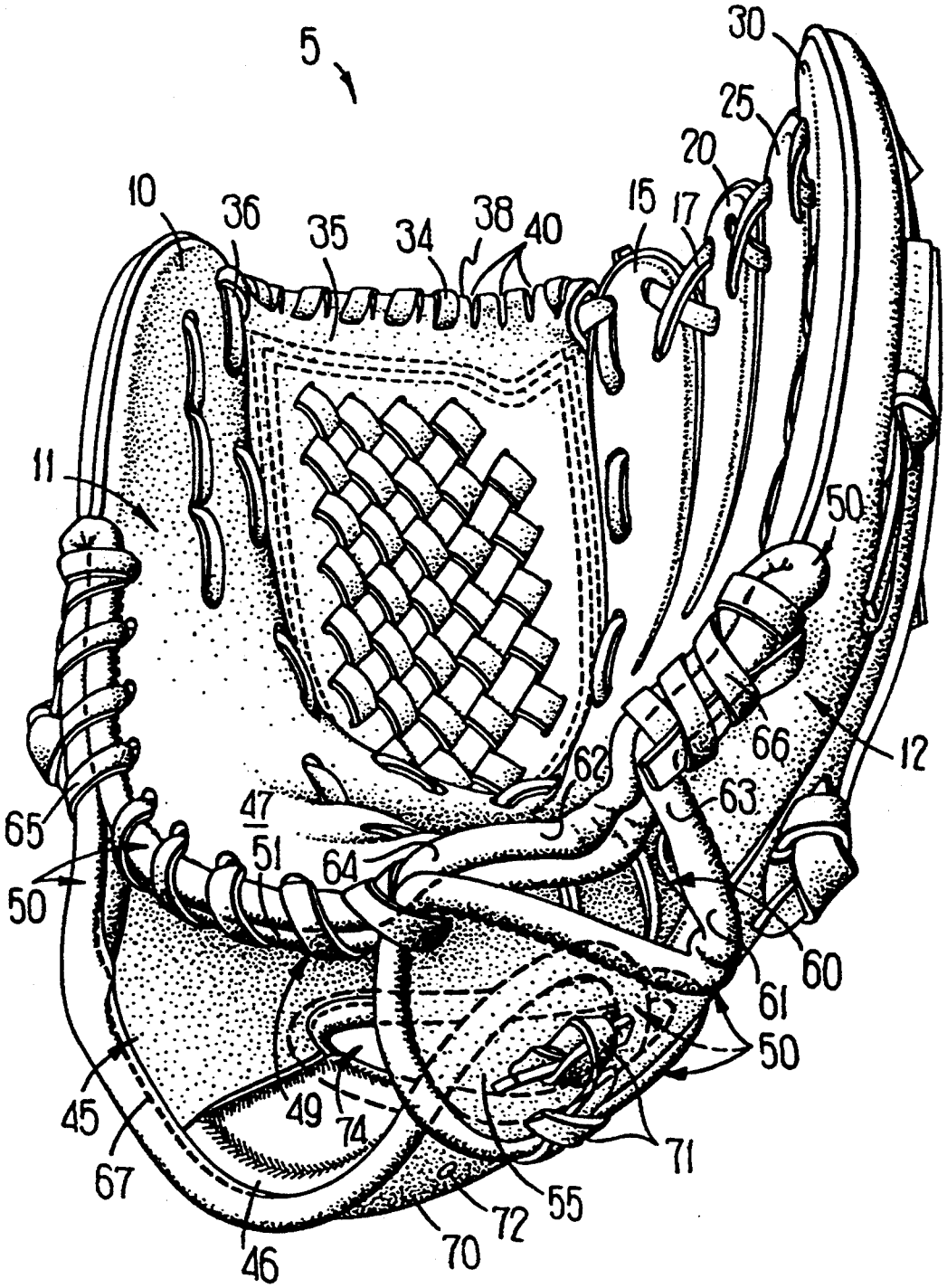
FIG. 1 is a front, bottom, right side perspective view of the baseball glove according to a first embodiment of the present invention in an open position.
Figure 2:
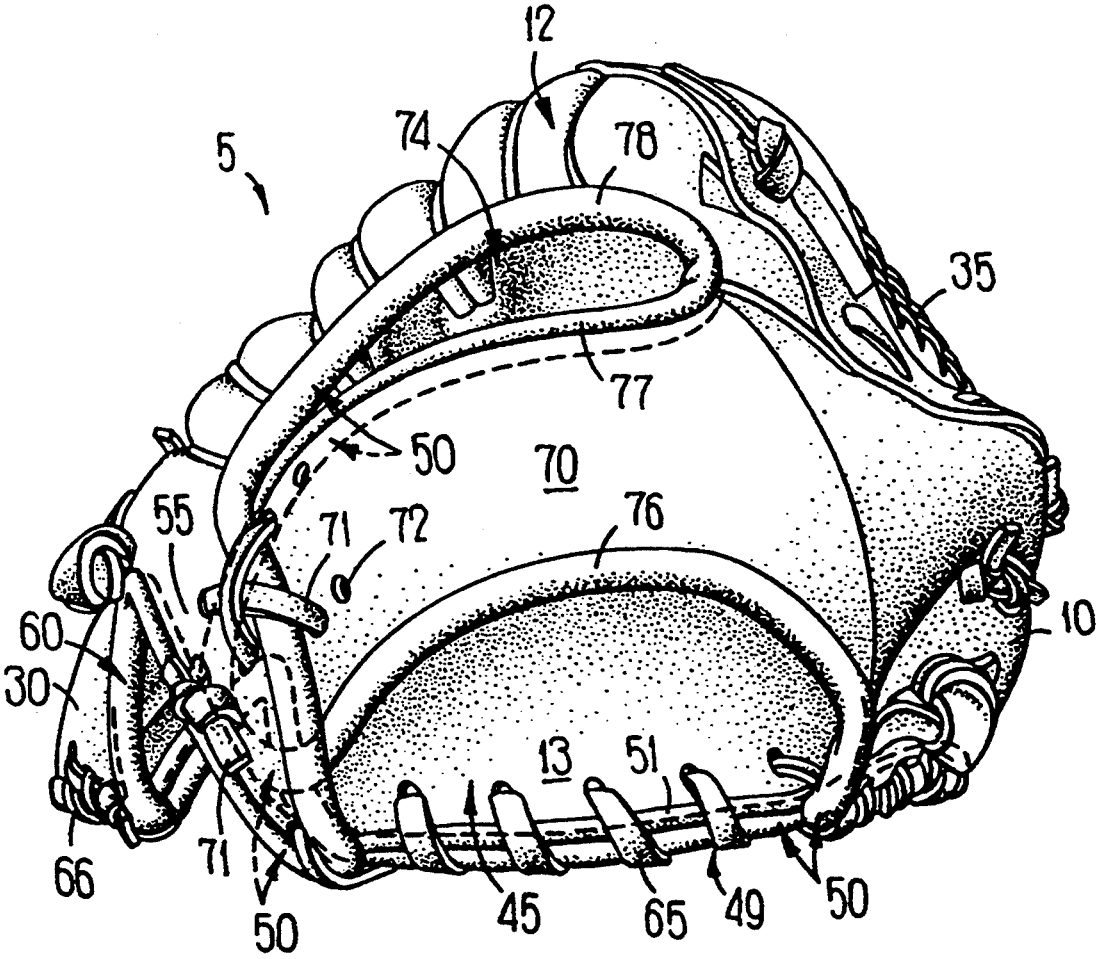
FIG. 2 is a bottom perspective view of the baseball glove according to a first embodiment of the present invention.
Figure 3:
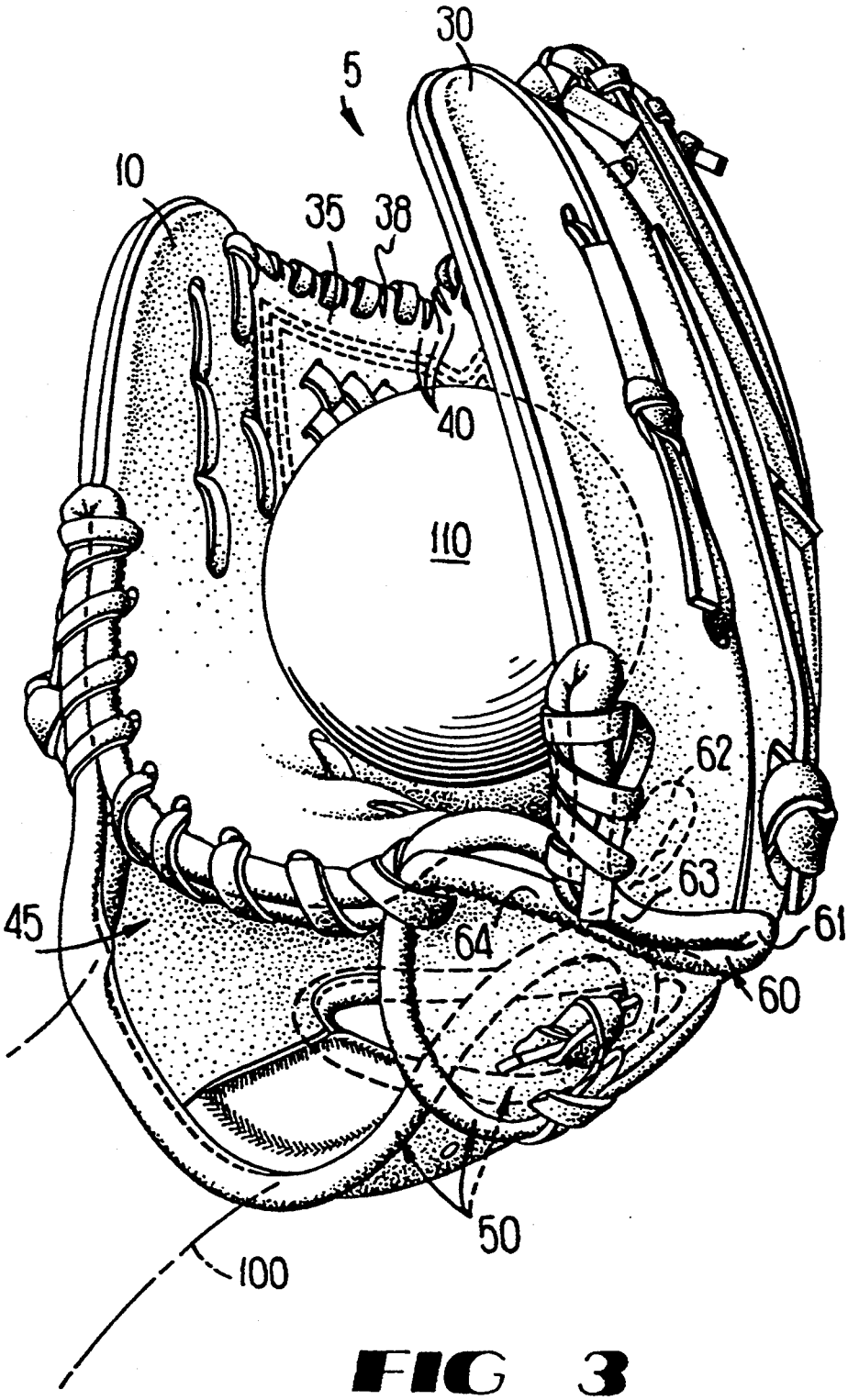
FIG. 3 is a front, bottom, right side perspective view of the baseball glove according to the present invention in a closed position, clutching a ball.

Referring now to the drawings, and more particularly to FIGS. 1 and 3, a baseball glove according to a first embodiment of the present invention is denoted by the numeral 5. Open back glove 5 is made of leather, although it may be constructed from any flexible material. The glove 5 is generally constructed from a front panel or ply 11 which forms a front portion of the glove and a back ply 12 which forms a back portion of the glove 5. Front and back plies 11 and 12 are fastened together by any suitable means (e.g., stitching) to form glove 5 having a thumb stall 10 as well as finger stalls 15, 20, 25, and 30, which house at least part of a ball player's fingers. Additionally, as seen in FIG. 2, an inner portion of glove 5 has an inner liner 13 fastened to front ply 11 so that appropriate padding or filler (not shown) may be inserted therebetween.

Web 35 is fastened to glove 5 between thumb stall 10 and index finger stall 15 by lacing 36 or by any other suitable fastening means. Each of the finger stalls are fastened to one another by lacing 17, so that the thumb stall, web, and finger stalls are stabilized with respect to one another. Slits 40 are formed in a top portion of web 35 between two adjacent lace loops 34 and serve to increase flexibility of glove 5 as will be discussed in greater detail below.

As seen in FIG. 2, strap 70 is integral with rear ply 12 and originates from a portion of rear ply 12 below web 35 and thumb stall 10. An outside edge 76 of strap 70 forms a first edge of hand receiving opening 45. Lower peripheral edge 78 of rear ply 12 and upper peripheral edge 77 of strap 70 form border inner opening 74. Strap 70 may be fastened by lace 71 through eyelets 72 to a lower portion 55 of back ply 12 or by any other suitable means (e g snaps, Velcro TM, stitching, etc.). Strap 70 may be adjusted for different sized wrists by choosing the appropriate set of eyelets 72 on strap 70. Strap 70 also contains a wrist pad 46 on an inner portion thereof to insure that strap 70 fits snugly and comfortably around the ball player's wrist and hand.

Hand receiving opening 45 of glove 5 is bordered on a top portion by heel 49 and is bordered on a lower portion by outside edge 76 of strap 70. Lower portions of front ply 11, inner liner 13 beneath front ply 11, filler (not shown) between ply 11 and liner 13, continuous lip 50, and liner binding 51 form heel 49 at a lower periphery of ply 11. Liner binding 51 in the vicinity of back notch portion 61 covers the outer periphery of inner liner 13. A V-shaped notch 60 is formed into heel 49, and palm 47 of glove 5, below little finger stall 30. V-shaped notch 60 has a front portion 62 formed in front ply 11 and a back portion 61 formed in rear ply 12 so as to fully extend through a cross section of the glove palm and heel. Front and back notch portions 62 and 61 are disposed opposite to one another when plies 11 and 12 are aligned and are separately bound by continuous binding 50. Continuous binding 50 provides a finished, appealing appearance for notch 60. Most importantly, separately bound front and back portions 62 and 61 of notch 60 serve to increase flexibility of glove 5 as will be discussed in greater detail below.

Continuous binding 50 forms a border for notch 60 as well as for the entire lower portion of the glove 5. As seen in FIGS. 1, 2, and 3, continuous binding 50 extends along rear ply 12 adjacent to pad 46 on strap 70 to about a mid-point of an outer portion of thumb stall 10, and then reverses direction and runs parallel to itself on an edge of front ply 11 along the outer portion of thumb stall 10. Binding 50 continues along heel 49 of front ply 11, bordering a top portion of hand receiving opening 45, and forms a border for front notch portion 62 in ply 11. Binding 50 then continues along an edge of front ply 11 on an outer portion of little finger stall 30, reverses direction and runs parallel to itself on an outer portion of rear ply 12 on little finger stall 30, borders back notch portion 61, and also borders lower portion 55 of ply 12. Binding 50 then forms an upper border of inner opening 74 and forms an inside border of strap 70. Binding 50 is shown in dashed lines in FIGS. 1, 2, and 3 where hidden. Liner binding 51 lies adjacent to continuous binding 50 and covers a periphery of liner 13. Liner binding 51 begins at about a mid-point of an outer periphery of thumb stall 10 and ends at little finger stall 30 near lacing 70. Lacing 65 fastens both portions of continuous binding 50 to each other near an outer periphery of thumb stall 10. Additionally, lacing 65 fastens continuous binding 50 and ply 11 to liner binding 51 and inner liner 13 near the heal 49, and also fastens lower portion 55 to heal 49. Stitching 67 fastens continuous binding 50 to plies 11 and 12. Finally, lacing 66 fastens front and rear plies 11 and 12 along a lower, outer edge of little finger stall 30.

In accordance with the invention, and illustrated in FIGS. 1 and 3, slits 40 and notch 60 serve to increase the flexibility of glove 5. V-shaped notch 60 is shown in the open position in FIG. 1. V-shaped notch 60 is strategically positioned between hand receiving opening 45 and a lower portion of little finger stall 30 so as to eliminate a portion of the palm that would resist a crease on heel 49 during the break-in period. The seam comprised of the border of plies 11 and 12 below little finger stall 30 is stiffer than a middle portion of palm 47, and that portion of heel 49 has been removed to form V-shaped notch 60 to decrease the stiffness of the same area. As illustrated in FIG. 3, when glove 5 closes, a top portion 63 of notch 60 collapses onto a bottom portion 64 of notch 60, eliminating the stiffness associated with creasing and bunching of plies 11 and 12, inner liner 13, and filler material between ply 11 and inner liner 13, thereby allowing a young ball player or others having low hand strength to easily open and close the glove, even when the glove is relatively new.

Continuous binding 50 is an important feature of V-shaped notch 60. The present invention provides for separate binding of front and back portions 62 and 61. As seen in FIG. 3, the separate binding arrangement allows the lower most portions or valley portions of notch portions 61 and 62 to effectively function as hinges, allowing top portion 63 to collapse onto bottom portion 64 of notch 60. The separate binding arrangement also allows for a space to be maintained between the valleys of front and back notch portions 62 and 61 during collapse for further flexibility. In addition to separately bound portions 61 and 62 of notch 60, lacing 65 terminates at bottom notch portion 64, and lacing 66 terminates at top notch portion 63, also allowing a distance to be maintained between front and back notch portions 61 and 62 which contributes to glove flexibility. Thus, a ball player's hand 100 easily closes glove 5 to clutch ball 110.

Slits 40 also increase the flexibility of the glove by reducing the web's resistance to bending or creasing. At least one slit may be used, however, between two to four slits have been found to work best. Slits 40 are located in a break in lacing 34 along edge 38 of web 35, decreasing the stiffness of top edge 38, and allowing a crease or fold to readily form in web 35 near slits 40. Although slits 40 may be formed along any portion of top edge 38, the present embodiment forms the slits 40 in the vicinity of index finger stall 15. Slits 40 and notch 60 may each be used alone or in combination with each other to decrease the stiffness of the glove 5. The illustrated embodiment, however, utilizes both the notches and slits to facilitate opening and closing of the glove.

Figure 4:
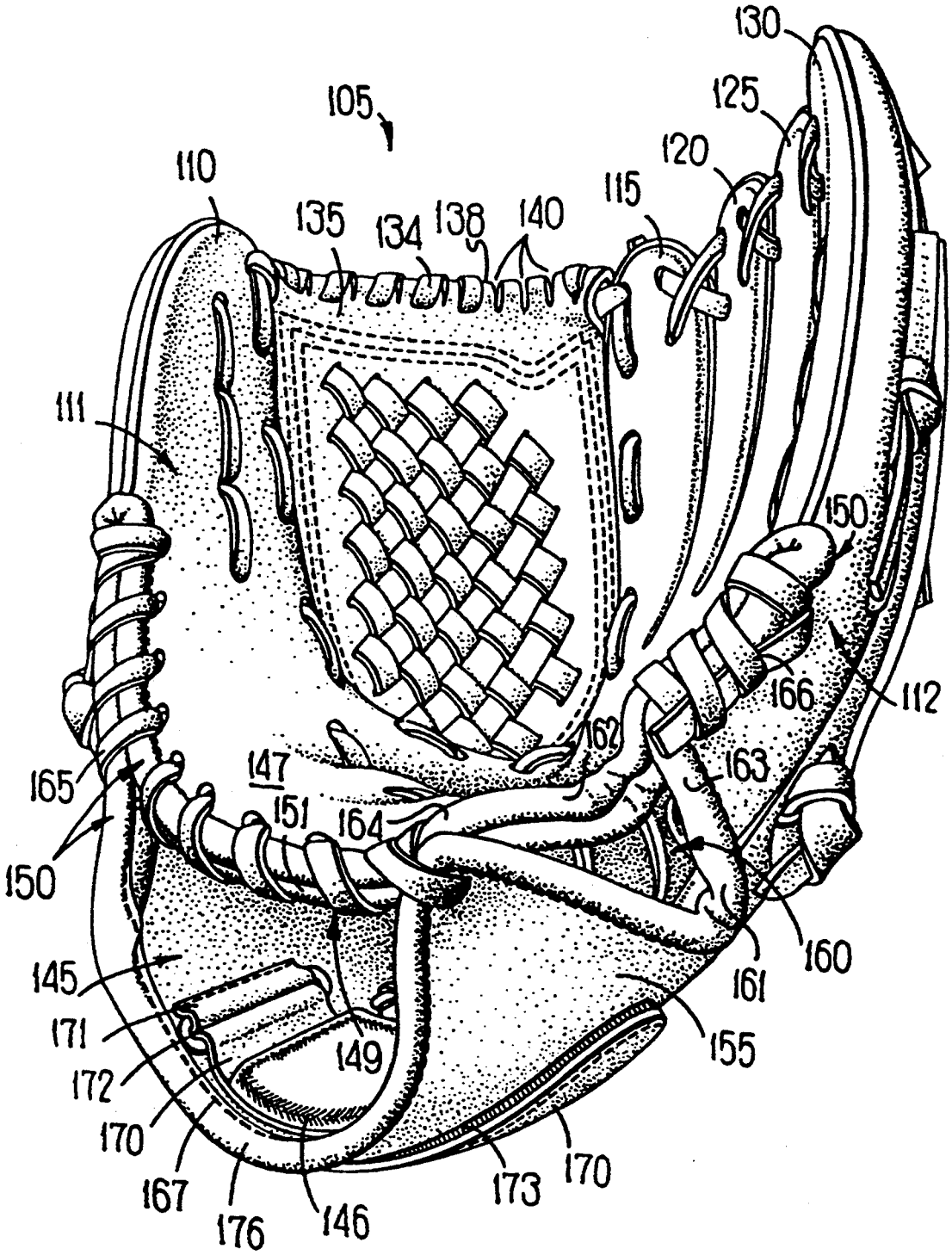
FIG. 4 is a front, bottom, right side perspective view of the baseball glove according to a second embodiment of the present invention in an open position.
Figure 5:
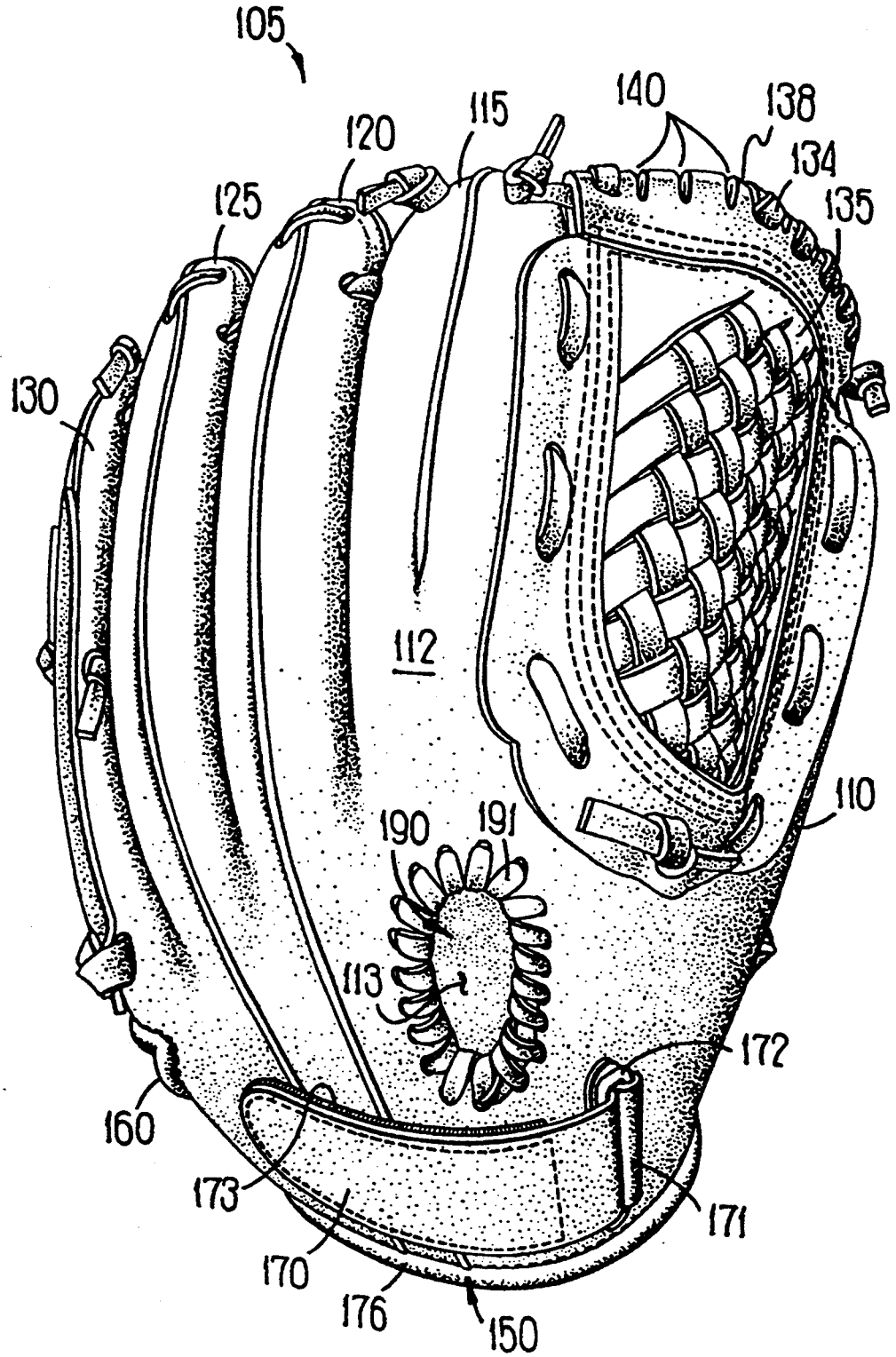
FIG. 5 is a rear perspective view of the baseball glove according to a second embodiment of the present invention.

FIGS. 4 and 5 illustrate a second embodiment of the present invention which utilizes the notch and web slits in a closed back style glove 105. Glove 105 is also formed by fastening flexible front and back plies 111 and 112 together to form thumb stall 110 and finger stalls 115, 120, 125, and 130. Glove 105 has finger port 190 bordered by lacing 191. Port 190 allows the ball player to extend an index finger therethrough for enhanced glove control. Strap 170 is fastened to an inner portion 145 of back ply 112 behind lower portion 55, extends through loop 172 and is adjustably fastened to an outer portion of ply 112 by Velcro TM 173 or any other fastening means such (e.g. buckles, snaps, lacing). Strap 170 is adjusted by extending strap 170 through loop 172, thereby engaging pad 146 against the ball player's wrist. Loop 172 is fastened to back ply 112 by link 171.

Hand receiving opening 145 of glove 105 is bordered on a front portion by heel 149 and is bordered on a back portion by edge 176 of back ply 112. Lower portions of front ply 111, an inner liner 113 beneath front ply 111, filler (not shown) between ply 111 and liner 113, continuous lip 150, and liner binding 151 form heel 149 at a lower periphery of ply 111. Liner binding 151 in the vicinity of back notch portion 161 covers the outer periphery of inner liner 113. A V-shaped notch 160 is formed into heel 149 and palm 147 of glove 105, below little finger stall 130. V-shaped notch 160 has a front portion 162 formed in front ply 111 and a back portion 161 formed in rear ply 112 so as to fully extend through a cross section of the glove palm and heel. Front and back notch portions 162 and 161 are disposed opposite to one another when plies 111 and 112 are aligned and are separately bound by continuous binding 150. Continuous binding 150 provides a finished, appealing appearance for notch 160. Most importantly, separately bound front and back portions 162 and 161 of notch 160 serve to increase flexibility of glove 105 in a manner similar to the first embodiment of the present invention.

Continuous binding 150 forms a border for notch 160 as well as for the entire lower portion of the glove 105. As seen in FIGS. 4 and 5, continuous binding 150 extends along edge 176 of rear ply 112 to about a mid-point of an outer portion of thumb stall 110, and then reverses direction and runs parallel to itself on an edge of front ply 111 along the outer portion of thumb stall 110. Binding 150 continues along heel 149 of front ply 111, bordering a top portion of hand receiving opening 145, and forms a border for front notch portion 162 of ply 111. Binding 150 then continues along an edge of front ply 111 on an outer portion of little finger stall 130, reverses direction and runs parallel to itself on an outer portion of rear ply 112 on little finger stall 130, borders back notch portion 161, and also borders lower portion 155 of ply 112 and continues back to edge 176 of back ply 112. Liner binding 151 lies adjacent to continuous binding 150 and covers a periphery of liner 113. Liner binding 151 begins at about a mid-point of an outer periphery of thumb stall 110 and ends at little finger stall 130 near lacing 170. Lacing 165 fastens both portions of continuous binding 150 to each other near an outer periphery of thumb stall 110. Additionally, lacing 165 fastens continuous binding 150 and ply 111 to liner binding 151 and inner liner 113 near the heal 149, and also fastens lower portion 155 to heal 149. Stitching 167 fastens continuous binding 150 to plies 111 and 112. Finally, lacing 166 fastens front and rear plies 111 and 112 along a lower, outer edge of little finger stall 130.

As illustrated in FIG. 4, slits 140 and notch 160 serve to increase the flexibility of glove 105 in a manner similar to the first embodiment. V-shaped notch 160 is shown in the open position in FIG. 1. V-shaped notch 160 is strategically positioned between hand receiving opening 145 and a lower portion of little finger stall 130 so as to eliminate a portion of the palm that would resist a crease on heel 149 during the break-in period. The seam comprised of the border of plies 111 and 112 below little finger stall 130 is stiffer than a middle portion of palm 147, and that portion of heel 149 has been removed to form V-shaped notch 160 to decrease the stiffness of the same area. When glove 105 closes, a top portion 163 of notch 160 collapses onto a bottom portion 164 of notch 160, eliminating the stiffness associated with creasing and bunching of plies 111 and 112, inner liner 113, and filler material between ply 111 and inner liner 113, thereby allowing a young ball player or others having low hand strength to easily open and close the glove, even when the glove is relatively new.

Continuous binding 150 is an important feature of V-shaped notch 160. The present invention provides for separate binding of front and back portions 162 and 161. As seen in FIG. 4, the separate binding arrangement allows the lower most portions or valley portions of notch portions 161 and 162 to effectively function as hinges, allowing top portion 163 to collapse onto bottom portion 164 of notch 160. The separate binding arrangement also allows for a space to be maintained between the valleys of front and back notch portions 162 and 161 during collapse for further flexibility. In addition to separately bound portions 161 and 162 of notch 160, lacing 165 terminates at bottom notch portion 164, and lacing 166 terminates at top notch portion 163, also allowing a distance to be maintained between front and back notch portions 161 and 162 which contributes to glove flexibility. Thus, a ball player's hand easily closes glove 105 to clutch a ball.

Slits 140 also increase the flexibility of the glove by reducing the web's resistance to bending or creasing. Slits 140 are located in a break in lacing 134 along edge 138 of web 135, decreasing the stiffness of top edge 138, and allowing a crease or fold to readily form in web 135 near slits 140. Although slits 140 may be formed along any portion of top edge 138, the present embodiment forms the slits 140 in the vicinity of index finger stall 115. Slits 140 and notch 160 may each be used alone or in combination with each other to decrease the stiffness of the glove 105. The illustrated embodiments however, utilize both the notches and slits to facilitate opening and closing of the glove.

It should be understood that various changes to the present invention may be made by the ordinarily skilled artisan, without departing from the spirit and scope of the present invention which is presented in the claims below. For example, the web slits may be formed along any portion of an upper edge of a glove web. The notch and slits may be used on any type of baseball or soft ball glove regardless of the number of finger stalls. Furthermore, the notch may have any shape which is appropriate for the particular glove on which they are employed. Finally, the notch may be located on any portion of the heal. Therefore, the ordinarily skilled artisan will understand that this disclosure presents an example of the invention and is not meant to limit the invention, as presented in the claims, in any way whatsoever.

What is claimed is:

1. A baseball glove comprising:

a front ply forming a palm and front portion of said glove;

a back ply forming a back portion of said glove;

means for fastening said front and back plies together at peripheral edges thereof to form said glove, wherein said glove includes;

a thumb stall, at least one finger stall, and a hand receiving opening;

a heel portion at a lower portion of said front ply; and a notch formed in a lower portion of said glove, such that said notch increases flexibility of said glove and facilitates opening and closing of said glove, wherein said notch includes first and second notch portions in said front and back plies, respectively, between said finger stall and said hand receiving opening, said notch portions disposed opposite one another at a lower portion of said palm such that said notch extends through an entire cross section of said glove.

2. A baseball glove comprising:

a front ply forming a palm and front portion of said glove;

a back ply forming a back portion of said glove;

means for fastening said front and back plies together at peripheral edges thereof to form said glove, wherein said glove includes;

a thumb stall, and at least one finger stall located at opposing side portions of said glove;

a hand receiving opening;

a heel portion at a lower portion of said front ply: and a notch formed in a lower portion of said glove, such that said notch increases flexibility of said glove and facilitates opening and closing of said glove, wherein said notch is formed in a lower side portion of said back ply, between said finger stall located at said side portion and said hand receiving opening.

3. A baseball glove comprising:

a front ply forming a palm and front portion of said glove;

a back ply forming a back portion of said glove; means for fastening said front and back plies together at peripheral edges thereof to form said glove, wherein said glove includes;

a thumb stall, at least one finger stall, and a hand receiving opening;

a heel portion at a lower portion of said front ply; and a notch formed in a lower portion of said glove, said notch including;

first and second notch portions in said front and back plies, respectively, between said finger stall and said hand receiving opening, said notch portions disposed opposite one another at a lower portion of said palm such that said notch extends through an entire cross section of said glove, wherein said first and second notch portions are separately bound such that said first notch increases flexibility of said glove and facilitates opening and closing of said glove.

4. The baseball glove of claim 3 further comprising:

a strap formed in said back ply for securing said glove onto a ball player's hand and wrist, wherein said strap originates from a portion of said rear ply near said thumb stall and further includes;

first and second peripheral edges, said first peripheral edge bordering an upper portion of said hand receiving opening, and said second peripheral edge and said lower peripheral edge of said back ply form an inner opening on said back portion of said glove; and a continuous binding fastened to portions of outer peripheries of said front and back plies, said continuous binding extending along said outer periphery of said strap to about a mid-point of an outer portion of said thumb stall on said back ply, said continuous binding reversing direction and running parallel to itself on a peripheral edge of said front ply along an outer portion said thumb stall, said continuous binding further extending along said heel on said front ply, forming binding on a front notch portion formed in said front ply, continuing along an outer portion of said front ply on said finger stall, reversing direction and running parallel to itself on an outer portion of said rear ply on said finger stall, binding a back notch portion formed in said back ply, extending around a lower portion of said back ply, forming an upper border of said inner opening on said back ply and binding said second peripheral edge of said strap.

5. The baseball glove of claim 3 further comprising:

a web fastened to said glove between said thumb stall and said finger stall, said web including;

at least one slit formed on a top edge of said web, wherein said slits decrease the stiffness of said top edge, thereby facilitating opening and closing of said glove.

6. The baseball glove of claim 3 further comprising:

a web fastened to said glove between said thumb stall and said finger stall, said web including;

at least one slit formed on a top edge of said web, wherein said slits decrease the stiffness of said top edge, thereby facilitating opening and closing of said glove.

7. The baseball glove of claim 4 further comprising:

a web fastened to said glove between said thumb stall and said finger stall, said web including;

at least one slit formed on a top edge of said web, wherein said slit decreases the stiffness of said top edge, thereby facilitating opening and closing of said glove.

8. The baseball glove of claim 3 further comprising:

a continuous binding fastened to portions of outer peripheries of said front and back plies, said continuous binding extending along said outer periphery of said back ply to about a mid-point of an outer portion of said thumb stall, said continuous binding reversing direction and running parallel to itself on a peripheral edge of said front ply along an outer portion said thumb stall, said continuous binding further extending along said heel on said front ply, forming binding on a front notch portion formed in said front ply, continuing along an outer portion of said front ply on said finger stall, reversing direction and running parallel to itself on an outer portion of said rear ply on said finger stall, binding a back notch portion formed in said back ply, extending around and binding a lower portion of said back ply, and binding a lower of said rear ply near said hand receiving opening.

9. The baseball glove of claim 8 further comprising:

a web fastened to said glove between said thumb stall and said finger stall, said web including;

at least one slit formed on a top edge of said web, wherein said slit decreases the stiffness of said top edge, thereby facilitating opening and closing of said glove.

10. The baseball glove of claim 3 further comprising:

first and second sections of lacing;

said first section of lacing fastening said front ply to said rear ply near said thumb stall and fastening a lower portion of said rear ply to a lower portion of said front ply;

said second section of lacing fastening said front ply to said rear ply near said finger stall;

wherein said notch is disposed between said first and second sections of lacing.

* * * * *